US011690153B2

(12) United States Patent
Johnston

(10) Patent No.: US 11,690,153 B2
(45) Date of Patent: Jun. 27, 2023

(54) LIGHTING SYSTEM

(71) Applicant: Blue Marble Enterprises Ltd., Carmel, CA (US)

(72) Inventor: John Johnston, Carmel, CA (US)

(73) Assignee: BLUE MARBLE ENTERPRISES LTD., Carmel, CA (US)

( * ) Notice: Subject to any disclaimer, the term of this patent is extended or adjusted under 35 U.S.C. 154(b) by 0 days.

(21) Appl. No.: 17/411,808

(22) Filed: Aug. 25, 2021

(65) Prior Publication Data

US 2022/0070986 A1 Mar. 3, 2022

Related U.S. Application Data

(60) Provisional application No. 63/072,620, filed on Aug. 31, 2020.

(51) Int. Cl.

| | |
|---|---|
| ***H05B 47/115*** | (2020.01) |
| *F21W 131/103* | (2006.01) |
| *F21S 8/08* | (2006.01) |
| *F21V 23/04* | (2006.01) |

(52) U.S. Cl.

CPC ..... *H05B 47/115* (2020.01); *F21S 8/085* (2013.01); *F21V 23/0471* (2013.01); *F21W 2131/103* (2013.01)

(58) Field of Classification Search

CPC ..... H05B 47/115; F21V 23/0471; F21S 8/085
See application file for complete search history.

(56) References Cited

U.S. PATENT DOCUMENTS

| | | | | |
|---|---|---|---|---|
| 8,188,685 | B1 | 5/2012 | Johnston | |
| 9,622,323 | B2 * | 4/2017 | Hartman | G01R 22/06 |
| 9,860,961 | B2 * | 1/2018 | Chemel | F21V 14/02 |

(Continued)

FOREIGN PATENT DOCUMENTS

| | | | |
|---|---|---|---|
| WO | WO2012064906 | A2 | 5/2012 |
| WO | WO2014147524 | A1 | 9/2014 |
| WO | WO2016156401 | A1 | 10/2016 |

OTHER PUBLICATIONS

IPO Search report dated Jun. 8, 2022, issued in connection with UK Appl. No GB2112389.8 (Date of search: May 6, 2022).

*Primary Examiner* — Alexander H Taningco
*Assistant Examiner* — Pedro C Fernandez
(74) *Attorney, Agent, or Firm* — Pequignot + Myers; Matthew A. Pequignot

(57) ABSTRACT

A lighting system including one or more light assemblies, each light assembly having a light-producing subassembly with one or more light sources for emitting light upon energization thereof, one or more sensors for sensing a preselected event, and a control subassembly, to control energization of the light source upon the sensor(s) sensing the preselected event. The light assembly also includes an internal communications subassembly, for effecting communications between the sensor and the control subassembly. The lighting system includes a command center, for providing commands to the control subassembly via the internal communications subassembly, and an external communications subassembly, for communicating the commands to the internal communications subassembly.

3 Claims, 8 Drawing Sheets

(56) References Cited

U.S. PATENT DOCUMENTS

| | | | | |
|---|---|---|---|---|
| 2012/0038281 | A1* | 2/2012 | Verfuerth | H05B 41/36 315/152 |
| 2015/0296599 | A1 | 10/2015 | Recker et al. | |
| 2018/0014392 | A1* | 1/2018 | Charlton | H05B 47/11 |

* cited by examiner

LIGHTING SYSTEM

CROSS-REFERENCE TO RELATED APPLICATION

This application claims the benefit of U.S. Provisional Application No. 63/072,620, filed on Aug. 31, 2020, and incorporates herein such provisional application in its entirety by reference.

FIELD OF THE INVENTION

The present invention is a lighting system including one or more light assemblies for emitting light therefrom upon energization thereof.

BACKGROUND OF THE INVENTION

In the prior art, lighting systems may be utilized, for example, to provide ambient lighting in a building (e.g., a warehouse, or other commercial facility) or on a street, or in a park. In general, however, the known lighting systems are limited to providing lighting, and the methods for controlling energization to the system are relatively simple.

For example, a lighting system may be energized when the ambient light has decreased to a preselected level, and de-energized when the ambient light is increased above the preselected level.

SUMMARY OF THE INVENTION

For the foregoing reasons, there is a need for a lighting system that overcomes or mitigates one or more of the disadvantages or shortcomings of the prior art.

In its broad aspect, the invention provides a lighting system including a light-producing subassembly that has one or more light sources for emitting light therefrom upon energization thereof. The light-producing subassembly preferably includes one or more light lenses through which the light emitted from the light source(s) is directed.

The lighting system also includes a power supply, one or more sensors for sensing a preselected event, a control subassembly, to control energization of the light source upon the sensor(s) sensing the preselected event, and an internal communications subassembly for effecting communications between the sensor and the control subassembly.

The lighting system also includes a command center for providing commands to the control subassembly via the internal communications subassembly, and an external communications subassembly, for communications between the command center and the internal communications subassembly.

BRIEF DESCRIPTION OF THE DRAWINGS

The invention will be better understood with reference to the attached drawings, in which.

DETAILED DESCRIPTION

Figure 1:
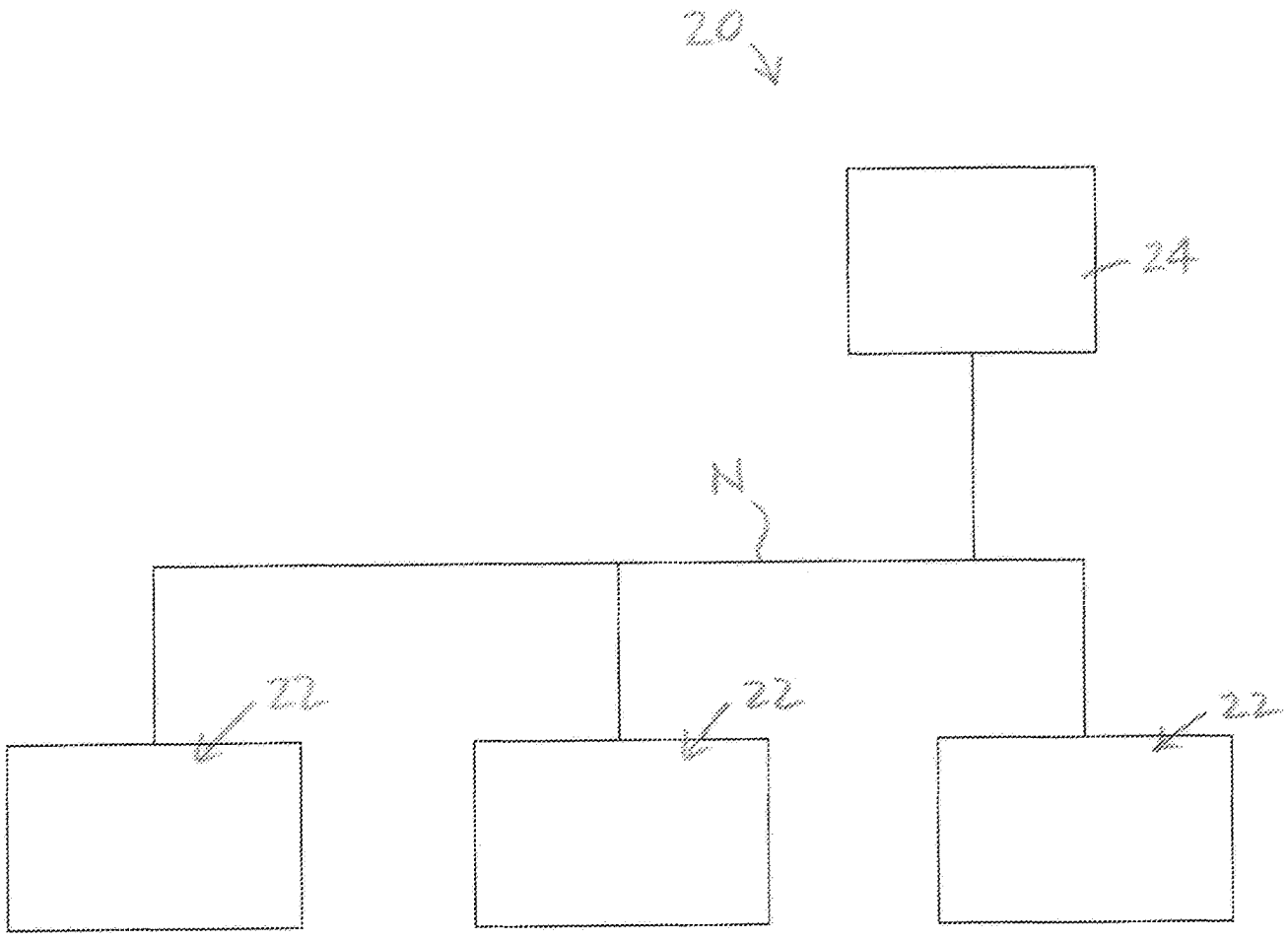
FIG. 1 is a schematic illustration of an embodiment of a lighting system of the invention, that includes one or more light assemblies.
Figure 2:
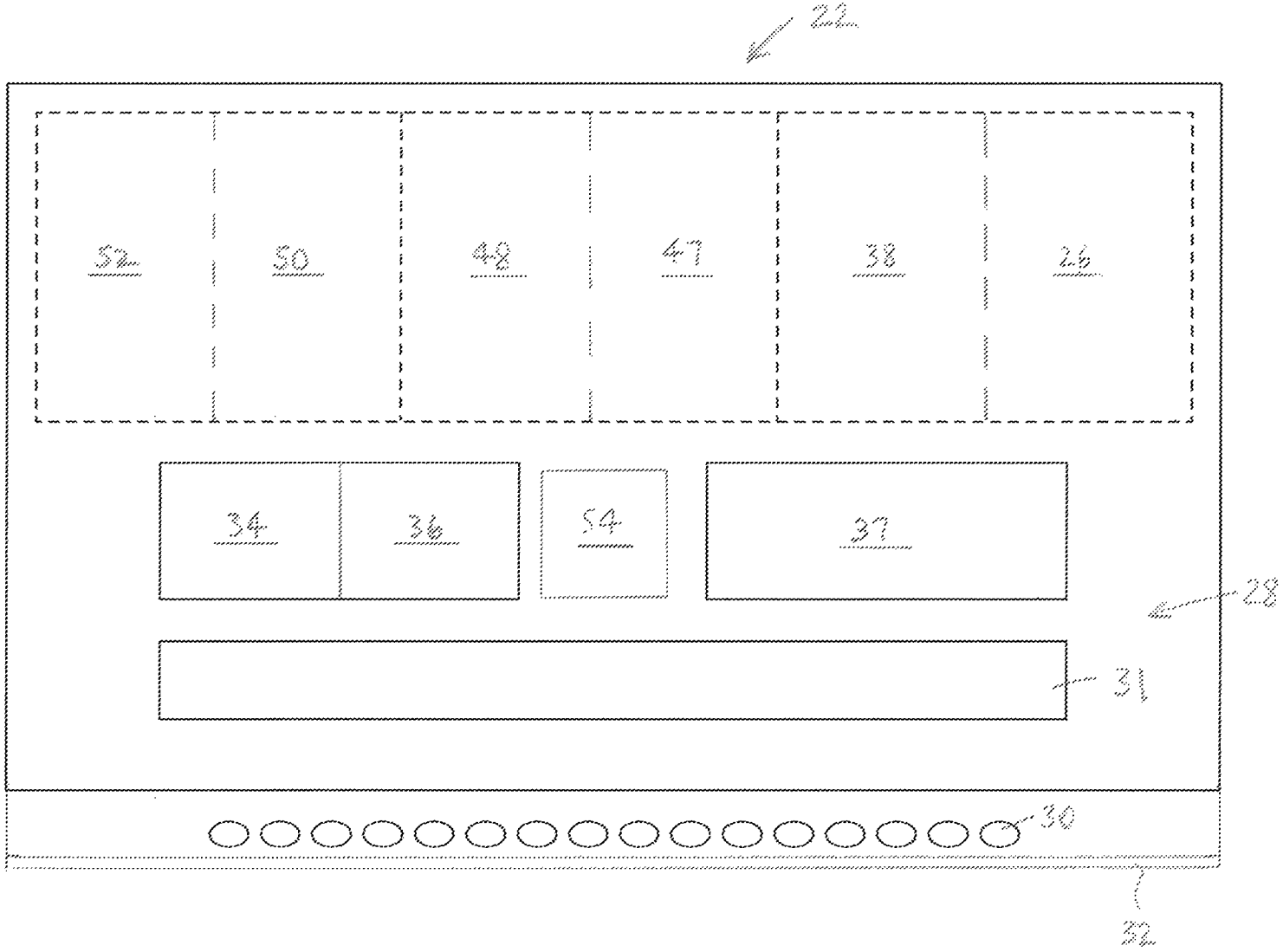
FIG. 2 is a schematic illustration of an embodiment of a light assembly of the invention.

In the attached drawings, like reference numerals designate corresponding elements throughout. Reference is first made to FIGS. 1 and 2 to describe an embodiment of a light system in accordance with the invention indicated generally by the numeral 20. Preferably, the lighting system 20 includes one or more light assemblies 22, a command center 24, and an external communications subassembly 26, as will be described.

Each of the light assemblies 22 preferably includes a light-producing subassembly 28 that includes one or more light sources 30, for emitting light therefrom upon energization thereof. The light sources 30 may be any suitable light sources. Each light assembly 22 also includes a power supply 31.

It is also preferred that the light-producing subassembly 28 includes one or more light lenses 32 through which the light emitted from the light source 30 is directable. Preferably, the light-producing subassembly 28 also includes one or more sensors 34, for sensing a preselected event, as will also be described.

The light-producing subassembly 28 preferably includes a control subassembly 36, to control energization of the light source(s) 30, upon the sensor(s) 34 sensing the preselected event. A monitoring module 37 included in the light-producing subassembly 28 monitors the power supply 31, the light sources 30, and the sensors 34. The light-producing subassembly 28 preferably also includes an internal communications subassembly 38, for effecting communications between the sensor(s) 34 and the control subassembly 36.

As noted above, it is also preferred that the lighting system 20 includes the command center 24, for providing commands to the control subassembly 36, and the external communications subassembly 26, for communicating the commands to the control subassembly 36 via the internal communications subassembly 38. The monitoring module 37 transmits information to the command center 24 of the system 20 via the external communications subassembly 26. As can be seen in FIG. 1, for example, the lighting assemblies 22 are in communication with the command center 24 via a network "N". It will be understood that the network "N" is any suitable network (e.g., wireless or otherwise) through which the light assemblies 22 may communicate with the command center 24 respectively, and the command center 24 may communicate with the light assemblies 22. It also will be understood that the command center 24 may be accessible via a smartphone application, or via the cloud, or via any other suitable means.

Figure 3A:
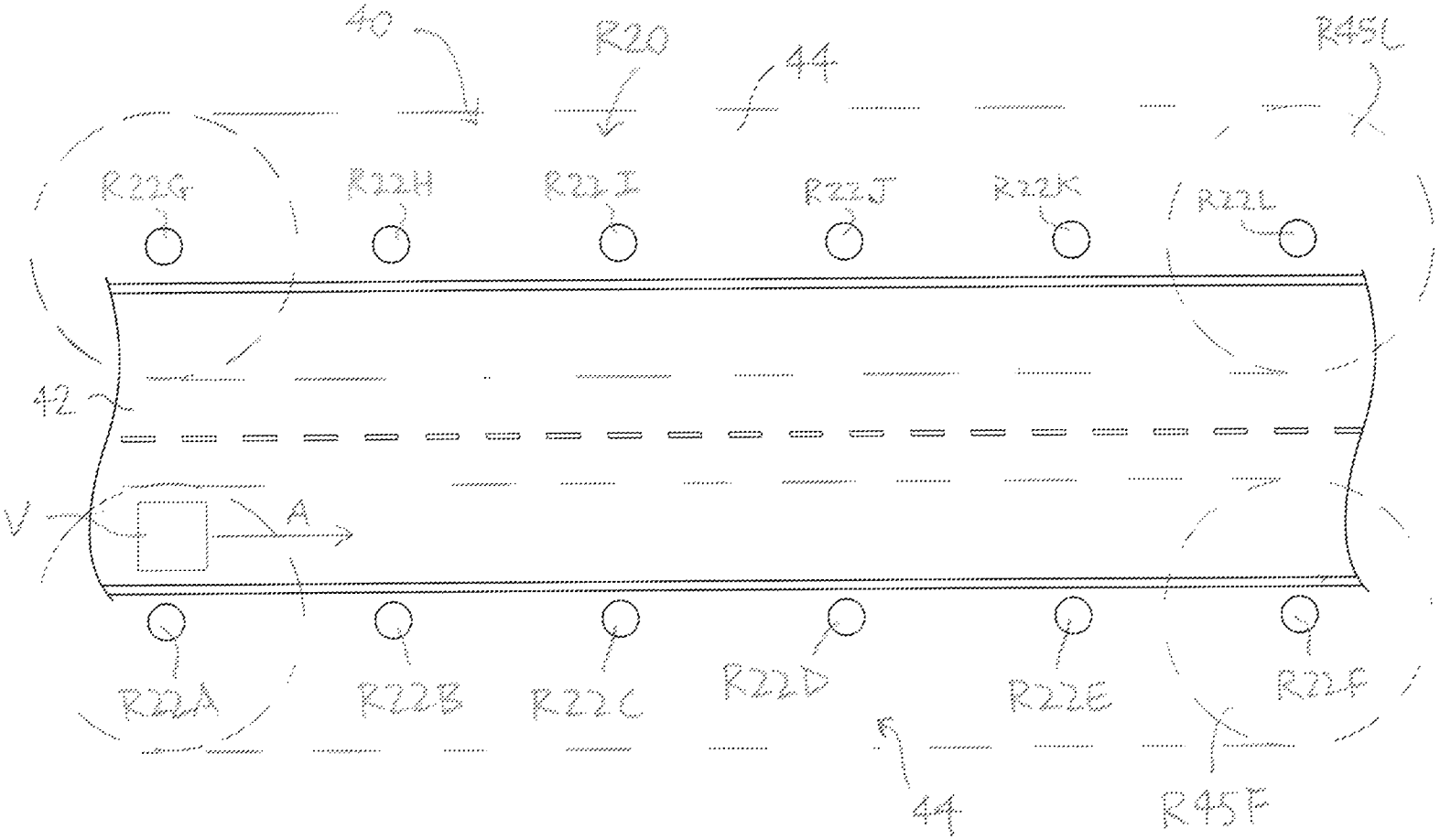
FIG. 3A is a top view of an embodiment of the light system of the invention, in which the light assemblies thereof are located to provide light along a street or road.
Figure 4:
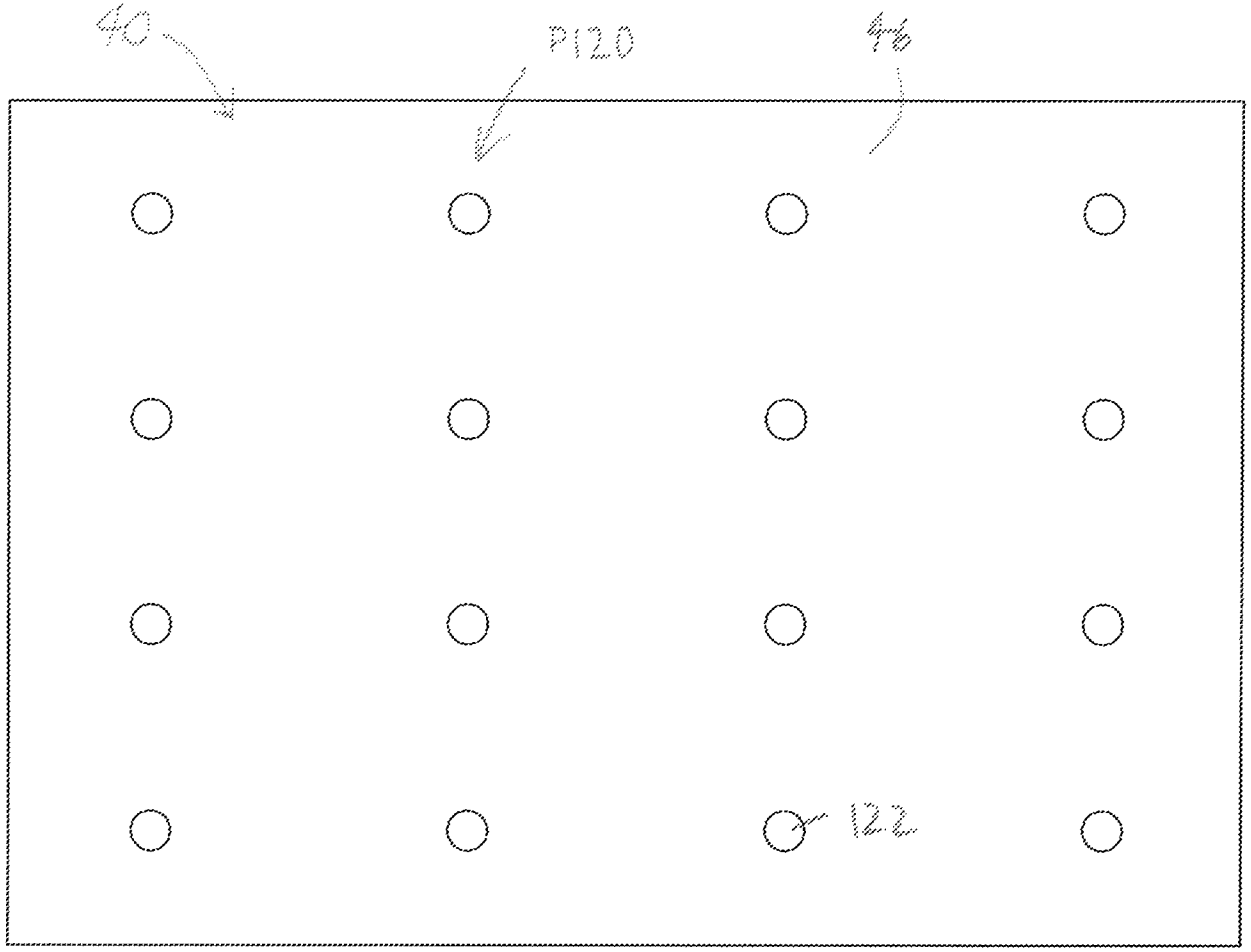
FIG. 4 is a top view of another embodiment of the light system of the invention, in which the light assemblies thereof are arranged to provide light over a predetermined area.

As can be seen in FIG. 3A, the lighting system 20 may be located to illuminate, or substantially illuminate, an area 40 including a street or road 42, and a region 44 surrounding the road 42. Alternatively, as illustrated in FIG. 4, the area 40 illuminated by the lighting system 20 may be, for example, a relatively more square area 46, such as a parking lot, or an area inside a warehouse or other building (not shown in FIG. 4). For clarity of illustration, the lighting system illuminating the road 42 and the region 44 is identified by reference character R20, and the lighting system illuminating the area 46 is identified by reference character P120.

It will be understood that the lighting systems R20, P120 may includes any suitable numbers of light assemblies. The lighting system R20 as illustrated in FIG. 3A includes a number of light assemblies, identified for clarity of illustration by reference characters R22A-R22L. Similarly, the lighting system P120 as illustrated in FIG. 4 preferably includes a number of light assemblies 122. The lighting system may include any suitable means for supporting the light assemblies 22, 122, e.g., light standards, as would be appreciated by those skilled in the art.

As can be seen in FIG. 3A, each of the light assemblies 22 illuminates a specific area below the respective light assemblies. For example, the areas illuminated by the light assemblies R22F and R22L are identified in FIG. 3A as R45F and R45L respectively, for purposes of illustration. However, those skilled in the art would appreciate that the specific areas that are illuminated by the light assemblies vary, depending on the amount of light produced by each light assembly, which may vary over time, and also depending on ambient light and atmospheric conditions. The areas illuminated by each light assembly may overlap with areas illuminated by light assemblies proximal thereto.

Referring to FIG. 2, it is preferred that the light source 30 in each light assembly 22 preferably includes a number of light-emitting diodes (LEDs). The power supply 31 provides energy to the LEDs 30, and also to other elements in the light assembly 22. The command center 24 (FIG. 1) is in communication with each light assembly 22 via the network "N", which connects with each light assembly 22 via the external communications subassembly 26 respectively. Those skilled in the art would appreciate that the command center 24 may be implemented via any suitable means, e.g., a smartphone application, or via the cloud. As noted above, the light assembly 22 preferably includes the monitoring module 37, which provides on-board diagnostics for light health monitoring, and for preventative maintenance. The monitoring module 37 is configured to provide diagnostic information to the command center 24 via the external communications subassembly 26.

It will be understood that the external communications subassembly 26 may be any suitable wireless or hardwired communications device or devices, configured to cooperate with the network "N". Preferably, the external communications subassembly 26 provides for wireless communications between the monitoring module 37 and the command center 24, and also between the command center 24 and the control subassembly 36.

At the command center 24, which may include, for example, any suitable processor (e.g., a smartphone), the processor may automatically respond to the diagnostic information, and/or a user (not shown) may respond by transmitting one or more commands to the control subassembly 36, via the external communications subassembly 26.

For example, diagnostic information provided by the monitoring module 37 may indicate that one or more of the LEDs in a particular light assembly 22 has failed, or may fail. When that information is transmitted to the command center 24, appropriate next steps may be determined. If one or more LEDs are to be replaced, for example, then the user may take the steps needed to replace the LEDs that need replacement.

The one or more sensors 34 included in the light assembly 22 may be any suitable sensors. For example, the sensor 34 may be a motion detection device, for light level optimization. As an example, if a vehicle "V" is moving past the light assembly R22A in the direction indicated by arrow "A" in FIG. 3A, such movement is sensed by the motion sensor 34, which transmits a signal to the control subassembly 36 to energize the light sources 30 in the vicinity of the vehicle "V", and in advance of the vehicle.

The control subassembly 36 may transmit another signal to the command center 24, indicating that motion is detected, and upon its receipt thereof, the command center 24 may transmit signals to the other light assemblies R22B-R22F, causing the light sources 30 in each of those light assemblies respectively to be energized, to provide light along the road 42 and the region 44. Alternatively, in addition to the light assemblies R22B-R22F, the command center 24 may also transmit signals to the light assemblies on the other side of the road 42 (i.e., the light assemblies R22G-R22L) to cause the light sources 30 in those light assemblies to be energized as well.

In one embodiment, the motion detection device preferably is configured to generate a first signal transmittable to the control subassembly 36. Upon receipt of the first signal, the control subassembly 36 preferably causes the light sources 30 to be energized so as to emit more of the light therefrom, due to motion detected by the motion detection device. For example, prior to transmission of the first signal, the light source 30 may be energized at a relatively low level, or the light source 30 may not be energized at all.

It is also preferred that the motion detection device 34 is configured to generate a second signal transmittable to the control subassembly 36 to cause the light source 30 to emit less of the light therefrom upon the motion detection device 34 detecting no motion during a predetermined time period. For example, after the vehicle "V" has passed the lighting system 20, in the absence of other traffic on the road 42, it is preferred that the light sources 30 are less energized (or not energized at all), in order to reduce unnecessary energy consumption.

From the foregoing, it can be seen that the monitoring module 37 preferably is an on-board diagnostics subassembly, for diagnosis of the light-producing subassembly 28, the sensor(s) 34, the control subassembly 36, and the internal communications subassembly 38. The on-board diagnosis subassembly 37 preferably is configured to generate a signal transmittable to the command center 24 via the external communications subassembly 26 upon the on-board diagnosis subassembly 37 determining that one or more of the light-producing subassembly 28, the sensor(s) 34, the control subassembly 36, and the internal communications subassembly 38 is malfunctioning.

As can be seen in FIG. 2, in one embodiment, the light assembly 22 preferably also includes one or more cameras 47, for obtaining images of a preselected region that is proximal to the light assembly 22. For instance, the preselected region for the light assembly R22F in FIG. 3 may be the area or region identified in FIG. 3 as R45F. Preferably, the camera 47 is configured to transmit the images obtained thereby to the command center 24 via the external communications subassembly 26, for review of the images.

Those skilled in the art would appreciate that the camera 47 may be activated in any suitable manner. For example, upon the motion detector 34 detecting motion, the motion detector 34 may transmit a signal to the camera 47, indicating that an image of the relevant region is to be obtained by the camera 47. Alternatively, upon the motion detector 34 detecting motion, the motion detector 34 may transmit a signal to the control subassembly 36, which then transmits an activation signal to the camera 47.

The images obtained by the camera 47 may be video images, or still photos. The images preferably are stored and then reviewed, in any suitable manner.

In an alternative embodiment, the light assembly 22 preferably also includes a radar unit 48, for radar surveillance of a predetermined region around the light assembly 22. The radar unit 48 may be configured to determine the speed of a vehicle moving through the predetermined region. Preferably, the radar unit 48 is configured to generate a radar detection signal transmittable to the command center 24 via the external communications subassembly 26. As will be described, in one embodiment, the radar unit 48 may be utilized to provide information to the vehicle "V" about any objects located on the road 42 that may be in the vehicle's path.

In another embodiment, the light assembly 22 preferably also includes a GPS unit 50, for identifying a location of the light assembly 22. The GPS unit 50 preferably is configured to generate a location signal transmittable to the command center via the external communications subassembly 26, confirming the location of the light assembly. The location signal facilitates prompt identification of the location of the light assembly 22, and when used with other data, e.g., the data from the radar unit 48, the location signal provides evidence of the speed at which a vehicle was travelling. As will be described, in one embodiment, the GPS unit 50 may alternatively be used to provide location information to moving objects (e.g., drones), for navigation purposes.

In another alternative embodiment, the light assembly 22 preferably also includes an alert subassembly 54 configured to generate an alert signal upon receiving an alert generating signal. The alert signal may, for example, be transmitted directly to the command center 24, to facilitate prompt action. In one embodiment, a suitable alert signal generating device (e.g., a button) that a user (not shown) may activate in case of emergency may be mounted in a suitable manner, e.g., on a light standard (not shown) on which the light assembly 22 is mounted.

Figure 3B:
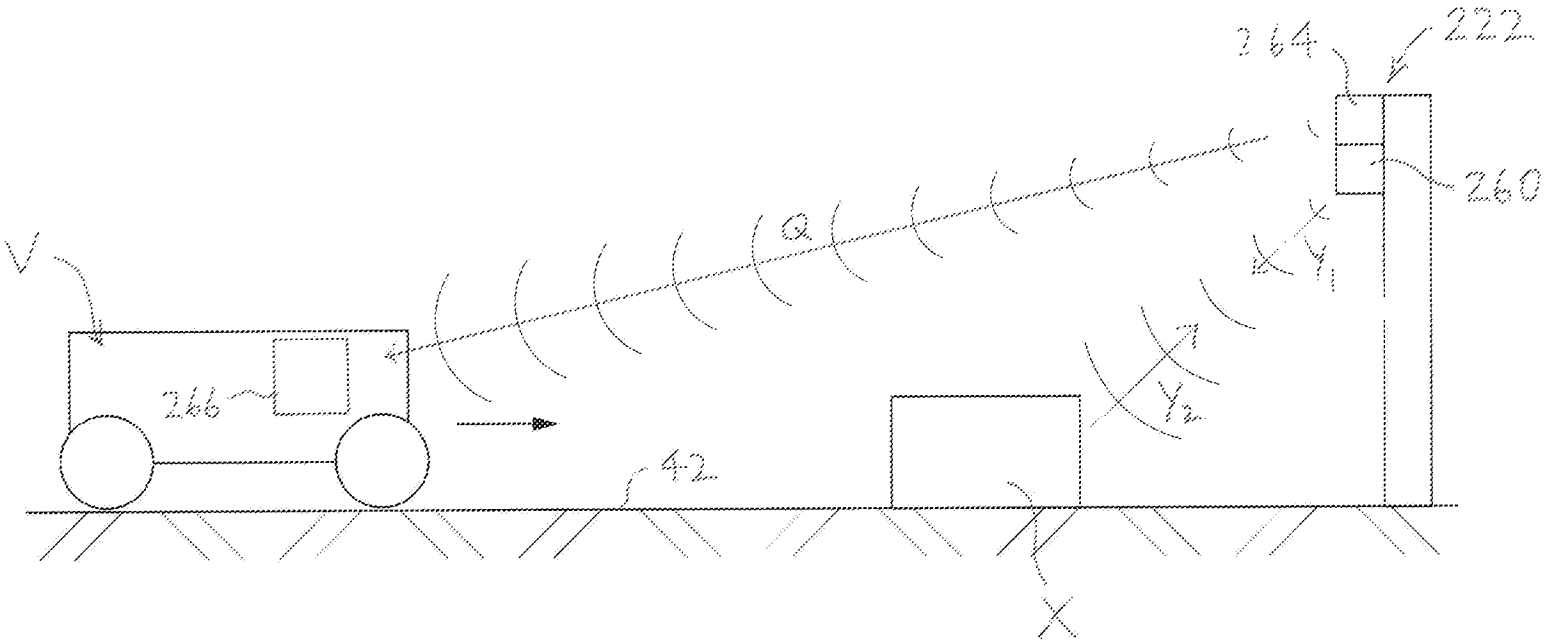
FIG. 3B is a schematic illustration of a vehicle in relation to the light system of FIG. 3A.

In one embodiment, schematically illustrated in FIG. 3B, a light assembly 222 of the invention preferably includes means for detection 260 that is configured to detect an object "X" that is located on or adjacent to the road 42. The means for detection 260 may be any suitable device using any suitable technology, e.g., the means for detection 260 may be the radar unit 48, for detecting the object "X".

In FIG. 3B, the detection of the object "X" by the radar unit 48 is schematically illustrated by arrows "Y1" and "Y2".

Preferably, upon detection of the object by the radar unit 48, an appropriate signal is generated thereby that is processed by the command center 24, generating a further, warning, signal that may be transmitted by a transmitter 264 to a receiver 266 in the vehicle "V". The transmission of the warning signal from the transmitter 264 to the receiver 266 may be by any suitable means, e.g, radio frequency, cellular network (e.g., via MMS), wifi, or bluetooth.

In FIG. 3B, the transmission of the warning signal to the receiver 266 is schematically represented by arrow "Q".

Those skilled in the art would appreciate that, if the vehicle "V" is autonomous, or semi-autonomous, then a control system (not shown) of the vehicle "V" that is in communication with the receiver 266 may utilize the information provided via the warning signal to take appropriate action, e.g., to avoid collision with the object "X".

It will also be understood that the light assembly 222 may provide other information to vehicles on the road 42. For example, the radar unit 48 may provide information about traffic flow to vehicles, via receivers 266 therein. Based on this information, the control system of the vehicle "V" may then direct the vehicle "V" to an alternate route, instead of the road 42.

Figure 3C:
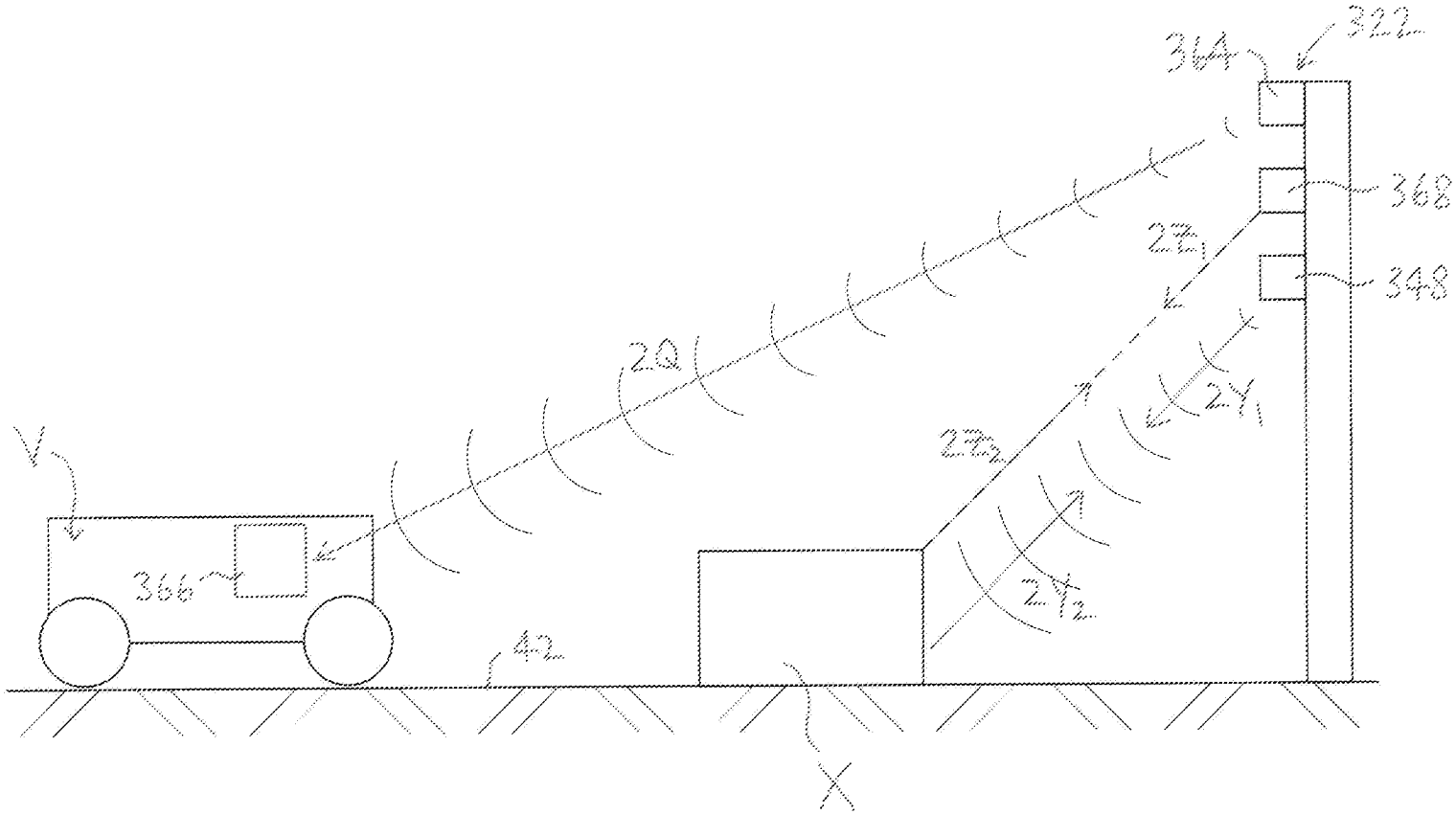
FIG. 3C is another schematic illustration of a vehicle in relation to the light system of FIG. 3A.

In FIG. 3C, another alternative embodiment of the light assembly 322 is illustrated. Preferably, the light assembly 322 includes a radar unit 348 and also includes a LIDAR unit 368.

Those skilled in the art would appreciate that radar and LIDAR have advantages and disadvantages that may be somewhat complementary. For example, radar does not allow for detection of smaller objects, but LIDAR does. However, LIDAR generally does not work well in cloudy weather, or at night. Radar works equally well in cloudy weather, or at night, and also provides a longer operating distance than LIDAR, for early detection of the object.

Accordingly, the light assembly 322 includes both the radar unit 348, and the LIDAR unit 368. In FIG. 3C, the detection of the object "X" by the radar unit 348 is schematically illustrated by arrows "2$Y_1$" and "2$Y_2$". Similarly, the detection of the object "X" by the LIDAR unit 368 is schematically represented by arrows "2$Z_1$", "2$Z_2$".

Preferably, the radar unit 348 and/or the LIDAR unit 368 generate signals processed by the command center 324, which transmits warning signals to the transmitter 364, which are transmitted to the receiver 366 from the transmitter 364.

In FIG. 3C, the transmission of the warning signal to the receiver 366 is schematically represented by arrow "2Q". The vehicle "V" may have a control system (not shown) in communication with the receiver 366, and such control system may cause the vehicle "V" to take appropriate action in view of the information provided to the vehicle's control system via the receiver 366.

Figure 5:
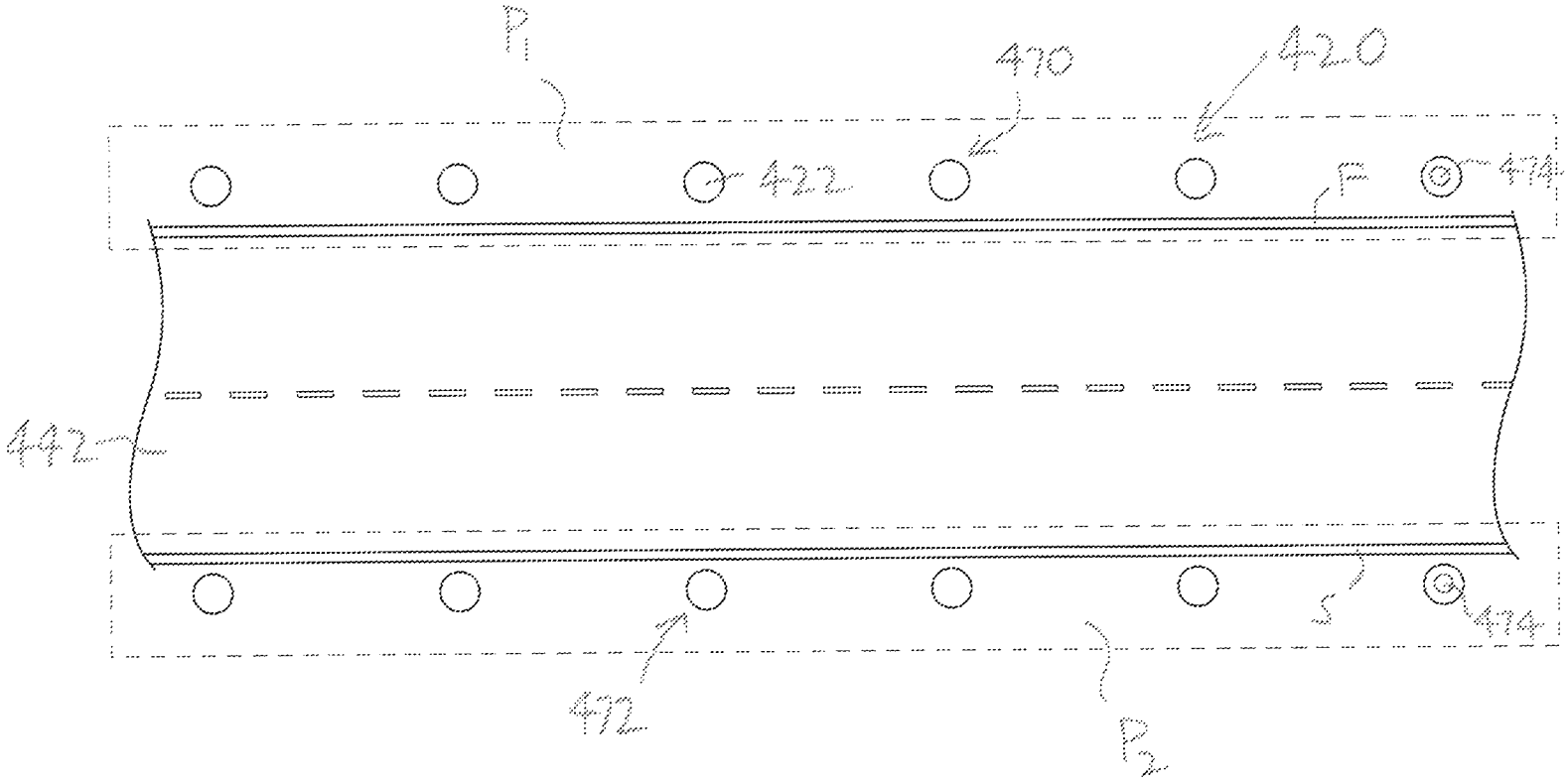
FIG. 5 is a top view of another alternative embodiment of the light system of the invention.

In FIG. 5, a lighting system 420 is illustrated, located beside and parallel to a road or street 442. The lighting system 420 preferably includes a number of light assemblies 422. In the example illustrated in FIG. 5, the light assemblies are arranged on both sides of the road 442. For clarity of illustration, the light assemblies 422 located on a first side "F" of the road 442 are collectively referred to as a first group 470 of light assemblies, and the light assemblies 422 that are located on a second side "S" of the road 442 are collectively referred to as a second group 472 of light assemblies 422.

Preferably, each of the light assemblies 422 includes a module 474 that is configured for communication with drones (and/or UAVs), to provide defined pathways, schematically represented by "$P_1$", "$P_2$" in FIG. 5. It will be understood that each of the pathways is also defined by predetermined minimum and maximum altitudes thereof (not shown), within the limits shown by "$P_1$", "$P_2$".

The module 474 preferably utilizes GPS and any suitable means of communication with the drones (e.g., RF, cellular, wifi, bluetooth communication), to provide useful information to the drones, and also to obtain useful information from the drones. For instance, precise GPS location of a drone, the airspeed and altitude of the drone, the drone's destination and flight time, distance and location to target, payload information, and other information may be obtained, and also provided, by the module 474. The module 474 preferably is in communication with other devices on the ground, to which information about the drone may be transmitted, from the module 474.

Those skilled in the art would appreciate that, among the advantages provided by the light system 420 are the pathway ("$P_1$", "$P_2$") that is partially defined by the locations of the groups 470, 472 of the light assemblies 422 that are located along each side of the road 442. It is believed that this arrangement may be used for air traffic control, to provide a convenient means for controlling the flight paths of drones, so that the drones may safely fly along the pathways thereby defined at preselected altitudes, without collision with each other or with other objects, whether flying or otherwise.

Figure 6A:
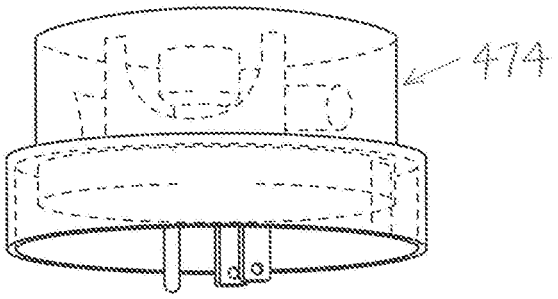
FIG. 6A is an isometric view of an embodiment of a module of the invention, drawn at a larger scale.
Figure 6B:
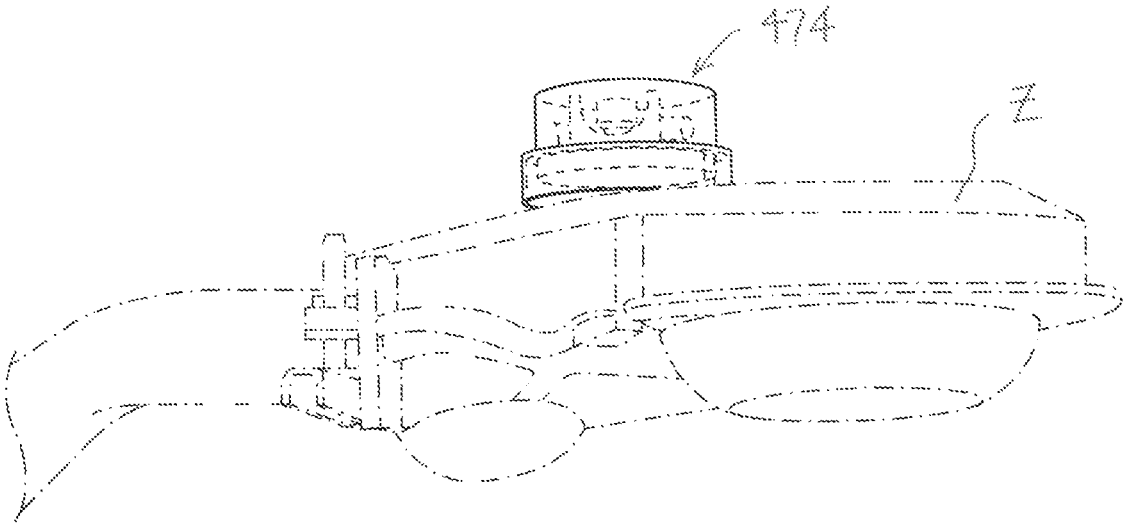
FIG. 6B is an isometric view of the module of FIG. 6A included in a streetlight, drawn at a smaller scale.

Those skilled in the art would appreciate that the module 474 may be in any suitable form. Advantageously, as can be seen in FIG. 6B, the module 474 may be in a form similar to a photocell of the prior art, and configured to cooperate with a prior art streetlight unit "Z" to mount on the top of the prior art streetlight unit "Z" (FIG. 6B). Alternatively, a module may be formed to resemble the prior art photocell but include selected elements of the invention herein (e.g., the monitoring module 37, the control subassembly 36, the external communications subassembly 26, and/or the GPS unit 50) adapted for cooperation with existing elements (e.g., light sources) in the prior art streetlight unit "Z".

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

We claim:

1. A lighting system comprising:

at least one light assembly comprising:

a light-producing subassembly comprising at least one light source for emitting light therefrom upon energization thereof, the light-producing subassembly comprising at least one light lens through which the light emitted from said at least one light source is directed;

a power supply;

at least one sensor, for sensing a preselected event;

a control subassembly, to control energization of said at least one light source, upon said at least one sensor sensing the preselected event; and an internal communications subassembly, for effecting communications between said at least one sensor and the control subassembly;

a radar unit, for radar surveillance of a predetermined region of a road proximal to said at least one light assembly, the radar unit being configured to generate at least one first notification signal upon detecting an object in the predetermined region;

a command center, for providing commands to the control subassembly via the internal communications subassembly; and an external communications subassembly, for transmittinq signals between the command center and the internal communications subassembly, wherein said at least one first notification signal is transmittable to the command center via the external communications subassembly, and wherein, upon receipt thereby of said at least one first notification signal, the command center generates at least one warning signal transmittable to a receiver in a vehicle on the road.

2. The system according to claim 1 in which said at least one light assembly additionally comprises a GPS unit, for identifying a location of said at least one light assembly, the GPS unit being configured to generate a location signal transmittable to the command center via the external communications subassembly.

3. The system according to claim 2 additionally comprising a LIDAR unit for surveillance of the predetermined region, the LIDAR unit being configured to generate at least one second notification signal, upon detecting the object in the predetermined region, transmittable to the command center via the external communications subassembly, wherein, upon receipt thereby of said at least one second notification signal, the command center thereupon generates said at least one warning signal transmittable to the receiver in the vehicle.

* * * * *